United States Patent [19]

Lipp

[11] Patent Number: 4,882,998

[45] Date of Patent: Nov. 28, 1989

[54] CAR FOR TRAVELING ALONG A SHEATHED CABLE

[76] Inventor: Xaver Lipp, Hohenstaufenstrasse 30, 7090 Ellwangen, Fed. Rep. of Germany

[21] Appl. No.: 186,464

[22] Filed: Apr. 26, 1988

[30] Foreign Application Priority Data

May 13, 1987 [DE] Fed. Rep. of Germany ..... 3715904

[51] Int. Cl.[4] ..... B61B 7/06

[52] U.S. Cl. ..... 104/112; 104/167; 14/23; 105/30

[58] Field of Search ..... 104/112, 89, 91, 113, 104/167, 93; 14/1, 18, 22, 23; 105/26.05, 26.1, 30, 142, 148, 149.1, 149.2, 150, 86

[56] References Cited

U.S. PATENT DOCUMENTS

| | | | |
|---|---|---|---|
| 952,539 | 3/1910 | Lugo-Vina | 104/167 X |
| 985,763 | 2/1911 | Robinson | 14/23 X |
| 1,122,000 | 12/1914 | Von Hassel | 104/167 |
| 3,533,357 | 10/1970 | Brandon | 104/113 |
| 4,509,430 | 4/1985 | Creissels | 104/112 X |

FOREIGN PATENT DOCUMENTS

| | | | |
|---|---|---|---|
| 1119317 | 12/1961 | Fed. Rep. of Germany | 14/23 |
| 1580875 | 3/1971 | Fed. Rep. of Germany . | |

*Primary Examiner*—Dennis H. Pedder
*Assistant Examiner*—Frank H. Williams, Jr.
*Attorney, Agent, or Firm*—Roylance, Abrams, Berdo & Goodman

[57] ABSTRACT

A car travels along a sheathed cable, especially a suspension cable of a bridge, with the cable sheathing being of sheet metal and forming a rabbet projecting radially outwardly and following a helical course in the lengthwise cable direction. The car has at least one drive member engaged in the rabbet grovoe limited on the side by the rabbet. The drive member can be moved by a drive device immovable relative to the car along the lengthwise axis of the cable, but movable on a track concentric with the lengthwise axis of the cable.

18 Claims, 1 Drawing Sheet

CAR FOR TRAVELING ALONG A SHEATHED CABLE

FIELD OF THE INVENTION

The present invention relates to a car for traveling along a sheathed cable, especially a bridge suspension cable.

BACKGROUND OF THE INVENTION

Since conventional suspension cables of bridges have smooth outer sheathings and the cable pitch is steep, conventional cars for traveling on such cables cannot be propelled by the tread rollers or bearing pulleys of the cars which engage one or more cables. The car is, therefore, traditionally provided with a cable winch. The cable winch includes a traction cable attached to the pylon on the bridge. This is particularly disadvantageous since workers must first climb the pylon while encumbered, and then fasten one end of a cable to this pylon.

SUMMARY OF THE INVENTION

An object of the present invention is to provide a car which simplifies the travel along a sheathed cable, especially a suspension cable of a bridge.

The foregoing object is obtained by a car for traveling along a sheathed cable having a metal sheathing forming a rabbet projecting radially outwardly and axially along the cable in a helical path. The car has at least one drive member constructed and joined at the side of the rabbet. The drive member can be moved by a drive means which is immovable relative to the car along the lengthwise axis of the cable, and can be moved on a track concentric with the lengthwise axis of the cable.

This drive member can be compared with a nut threaded onto a threaded pin. It is moved as a result of a rotational movement on a track concentric to the lengthwise axis of the cable, similar to a nut on a thread, corresponding to the extension of the rabbet lengthwise along the cable. Because of the relatively immovable connection of the drive member with the car in the lengthwise direction of the cable, particularly in the direction of forward movement of the car, the thrust of the drive member drives the car along the length of the cable. The car according to the present invention is therefore provided with a suitable forward movement device, and thus, requires no traction cable or the like.

When the cable along which the car is to be moved has within the travel area an ascent or inclination always in the same direction, as can be the case with suspension cables of bridges, the drive means can be supported in only one direction, namely, in ascending direction of travel by supporting means immovably engaged with the car. Such drive means is then supportable, for instance, over a thrust bearing or block.

The drive member can include a groove shaped to receive the rabbet such that one or the other fitted side installed directly on the rabbet engages in the groove. The drive member, however, can also additionally or exclusively engage in the helical groove of the sheathing, limited on the side by the rabbet. If a forward thrust is required only in one direction, it is sufficient to construct the material part of the drive member engaging in the groove so that it comes into engagement on the rabbet only on one of its sides. If a forward thrust is required in both directions, however, a more advantageous construction involves the material part being only slightly narrower than the helical groove in the sheathing.

A manually powered device could be provided as the drive means. Generally speaking, however, a motor is provided as the drive means.

The drive member preferably comprises at least two parts arranged one behind the other along the helical path of the rabbet and trapping the cable therebetween. A secure engagement of the rabbet in the groove of the drive member or a secure engagement of the material part in the sheathing helical groove, limited on the side by the rabbet, is guaranteed by this arrangement. The drive member can also be constructed so that at least two coils of the helix formed by the rabbet simultaneously support the drive member. Furthermore, a drive member of this sort can also fulfill the function of a bearing pulley. This is especially important when the parts of the drive member are arranged in a rotatable ring concentrically surrounding the cable and rotatable by the drive means. The ring comprises at least two parts which are detachably connected with each other, so that the drive means can be turned around or moved away from the cable.

A second ring, axially spaced from the other ring, can be provided to reduce the load on the rabbet. With use of the drive member as a bearing pulley, the second ring will stabilize the car.

Rolling friction could be provided between the drive member and the cable. However this would be relatively costly. Therefore, the drive member is preferably constructed as a friction shoe, which friction shoe can be pressed down on the sheathing when necessary by a spring force to compensate for tolerances.

The car according to the present invention can be used as an inspection vehicle or material transport. However, it can also be configured with a machine for applying the sheathing, and then can be used as a work platform for application of the sheathing.

At least one bearing pulley can be provided running on the cable. Despite the sheathing having the projecting rabbet, the cable can be traveled without any problem, if the bearing pulley or pulleys of the car engaged on the sheathing have transverse slots in their bearing grooves for receiving the rabbets.

Generally, the center of gravity of the car will be located at a sufficient distance below the cable to be traveled that the moment of reaction, exerted by the drive means for the drive member on the car, swings the car out only slightly to the side from the position occupied when not being driven. Additional protection against swivel of the car can be provided. If at least one additional cable is present, running parallel to the main cable, then the swivel protection arrangement can comprise a holding member mounted on the parallel additional cable, which holding member is preferably configured as a cylinder or spool. Such holding member can be the bearing pulley of the car with transverse slots in its bearing groove. If no parallel cable is present, the swivel protection arrangement can include a counterweight placed at some distance from the cable lengthwise axis. The counterweight exerts a moment on the car directed against the reaction moment of the drive device.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF PREFERRED EMBODIMENT

Figure 1:
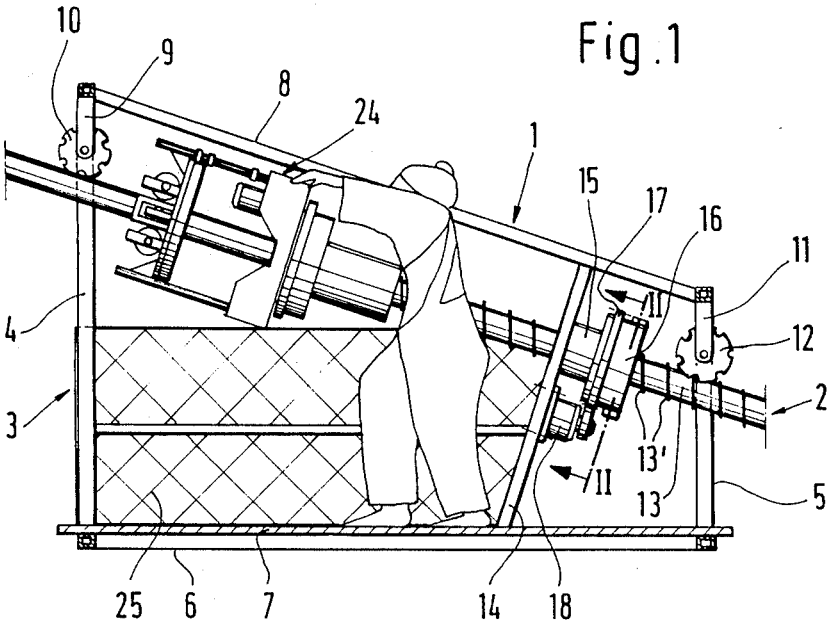
FIG. 1 is a side elevational view partially in section of a car according to the present invention.

A car according to the present invention indicated in its entirety as 1, is intended to travel on cable 2, provided with a sheet metal sheathing. In the exemplary embodiment, the cable is the suspension cable of a bridge. The car has a suspension installation 3 composed of profile rods because of the weight consideration. A front frame 4 and a rear frame 5 of suspension installation 3 are connected with each other by bottom longitudinal beams 6 and by top longitudinal beams 8. Bottom longitudinal beams 8 support a bottom plate 7.

A top transverse strut of front frame 4 is connected detachably with both vertical girders of front frame 4 to be able to bring cable 2 inside the frame. Two side bearing members extend downwardly from the strut, and rotatably support therein the axis or axle of a first traveling wheel 10 placed on cable 2 from above. In a corresponding manner, two downwardly extending side bearing members 11 are fastened to the top transverse strut of rear frame 5. The top transverse strut of rear frame 5 is detachably connected with the vertical girders. The downwardly extending side bearing members 11 support the axis or axle of a second traveling wheel 12 placed from above on cable 2 in the same manner as the first traveling wheel 10.

The bearing groove of the two identical traveling wheels 10 and 12 is provided with transverse slots. The circumferential spacing of the transverse slots, as well as the breadth and depth of the bearing groove, are adapted for engagement with a rabbet or rib 13' running concentrically to the lengthwise axis of the cable. The rabbet is formed by a sheet metal sheathing 13 tightly surrounding the core of cable 2. Rabbet 13' projects radially outwardly like a thread of a threaded pin or rod. The rabbet forms the side facing limit of a groove or slideway, which like the rabbet, extends along a helical path concentric to the lengthwise axis of the cable.

In the vicinity of rear frame 5 and inside suspension installation 3, a suspension construction forms a platform 14 with cable 2 passing perpendicularly through it. Platform 14 is divisible for the passage of cable 2, and supports a thrust block 15 on its bottom or rearward side. Thrust block 15 surrounds cable 2, and thus, is likewise divisible.

A hollow cylindrical metal housing 16 is mounted on thrust block 15 and is rotatable around the lengthwise axis of cable 2. Housing 16 concentrically surrounds cable 2, and therefore, is also divisible. The outside covering of metal housing 16 is provided with a toothed rim 17. Toothed rim 17 engages the impelling drive mechanism of an electric motor 18 fastened on the rearward side of platform 14, similar to thrust block 15.

Figure 2:
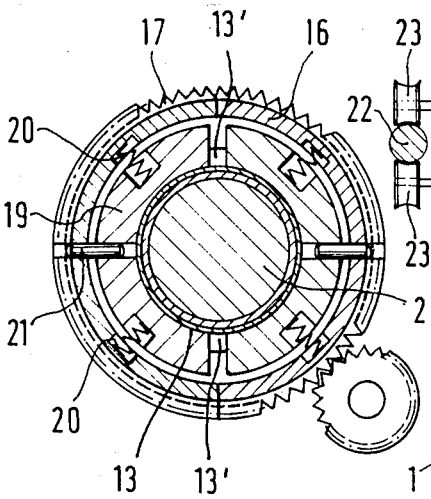
FIG. 2 is a end elevational view in section of the car drive member and drive means taken along line II—II of FIG. 1.

As shown in FIG. 2, two plastic friction shoes 19 are arranged within metal housing 16. Each shoe 19 extends over an arc of somewhat less than 180 degrees. Together, the two shoes form a course of a coil corresponding to helical rabbet 13', and hold cable 2 between them. These two friction shoes 19 engage in the groove limited on the side by rabbet 13', and are pressed against the bottom of the groove by springs 20. The springs are supported on the their other ends against housing 16. Each carrier bolt 21 of metal housing 16 penetrates into the respective one of the two friction shoes 19 by half its length in the radial direction from the outside of the shoes, and serves to carry along that friction shoe 19. As a result of the bearing of each friction shoe 19 on a carrier bolt 21, friction shoes 19 can be aligned without hindrance on the groove, and can be forced in radial direction under the effect of springs 20.

Figure 3:
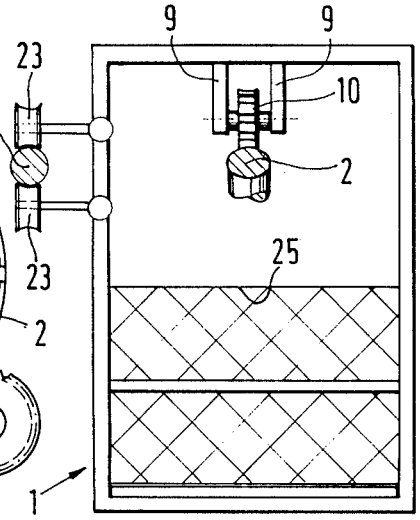
FIG. 3 is a front elevational view of the car of FIG. 1.

If a second cable 22 extends parallel and adjacent to the main cable 2 which is to be traveled, the car 1 can be secured in a simple manner against a swivel movement around the lengthwise axis of cable 2. As shown in FIG. 3, guard rollers 23 are provided for this purpose, and trap cable 22 between them. To simply join these guard rollers 23 to cable 22, and to be able to remove them from cable 22, the axes or axles of the guard rollers, as shown in the exemplary embodiment, are each connected with installation 3 through an adjustable swivel bearing arrangement.

Car 1 in the exemplary embodiment forms the work platform for the operation of a machine 24. Machine 24 applies the sheet metal sheathing along with formation of rabbet 13' over the core of cable 2 or over a protective layer applied beforehand to the core. A suitable machine for this purpose is disclosed in U.S. patent application Serial No. 076,722 to Lipp, the subject matter of which is hereby incorporated by reference. Bottom plate 7 then extends sufficiently far forward from platform 14, in the installation 3, as required for operation of machine 24. Installation 3 is provided on the sides and the front with protective grating 25 for protection of the persons standing on plate 7.

The adjustable speed electric motor can be operated so that car 1 on the one hand can be brought rapidly into a work position or out of a work position back into its starting position, and on the other hand can be subjected to precise positioning, especially with reference to machine 24. Also, its movement can be reversed, in order to be able to drive metal housing 16 in both directions.

While a particular embodiment has been chosen to illustrate the invention, it will be understood by those skilled in the art that various changes and modifications can be made therein without departing from the scope of the invention as defined in the appended claims.

What is claimed is:

1. A car for traveling along a sheathed cable having a metal sheathing forming a rib projecting radially outwardly and extending axially along the cable in a helical path, said car comprising:

at least one drive member having coupling means for engaging the rib laterally and at least two relatively movable parts arranged one behind the other along the helical path of the rib, said parts trapping the cable therebetween and having biasing means for urging said parts against the cable; and drive means, coupled to said drive member, for moving said drive member along a track concentric with a longitudinal axis of the cable, said drive means being stationary in axial directions of the cable relative to the car.

2. A car according to claim 1 wherein said drive member comprises means defining a groove shaped for receiving the rib.

3. A car according to claim 1 wherein said parts are received in a helical groove defined in the sheathing, said parts being limited on one side by the rib and entering the groove laterally.

4. A car according to claim 3 wherein each of said parts has a width smaller than a corresponding width of said helical groove.

5. A car according to claim 1 wherein said drive means comprises a motor.

6. A car according to claim 5 wherein said motor comprises adjustable speed means.

7. A car according to claim 5 wherein said motor is rotatable in opposite directions.

8. A car according to claim 1 wherein said parts of said drive member are arranged on a first ring concentrically surrounding the cable, said ring being a portion of said drive means.

9. A car according to claim 8 wherein a second ring with a drive member is spaced from said first ring in an axial direction of the cable.

10. A car according to claim 1 wherein each of said parts of said drive member comprises a friction shoe.

11. A car according to claim 1 wherein said biasing means comprise spring means.

12. A car according to claim 1 wherein a machine for applying the sheathing with the rib is axially spaced from said drive member and said drive means; and a bottom extends over an axial length corresponding to said machine, said drive member and said drive means.

13. A car according to claim 1 wherein at least one bearing pulley bears on the cable, said pulley comprising a bearing groove with transverse slots engaging the rib.

14. A car according to claim 1 wherein protection means are provided for preventing swivelling of the car.

15. A car according to claim 14 wherein said protection means comprises a second cable extending adjacent to and generally parallel to the sheathed cable, and at least one swivel stop member braced on said second cable.

16. A car according to claim 14 wherein said protection means comprises a counterweight spaced from a longitudinal axis of the cable.

17. A car for traveling along a sheathed cable having a metal sheathing forming a rib projecting radially outwardly and extending axially along the cable in a helical path, said car comprising:

at least one drive member having coupling means for engaging the rib laterally;

drive means, coupled to said drive member, for moving said drive member along a track concentric with a longitudinal axis of the cable, said drive means being stationary in axial directions of the cable relative to the car;

a machine for applying the sheathing with the rib being axially spaced from said drive member and said drive means; and a bottom extending over an axial length corresponding to said machine, said drive member and said drive means.

18. A car for traveling along a sheathed cable having a metal sheathing forming a rib projecting radially outwardly and extending axially along the cable in a helical path, said car comprising:

at least one drive member having coupling means for engaging the rib laterally;

drive means, coupled to said drive member, for moving said drive member along a track concentric with a longitudinal axis of the cable, said drive means being stationary in axial directions of the cable relative to the car; and at least one bearing pulley bearing on the cable, said pulley having a bearing groove with transverse slots engaging the rib.

* * * * *